US008289217B2

(12) United States Patent
Petrucci et al.

(10) Patent No.: US 8,289,217 B2
(45) Date of Patent: Oct. 16, 2012

(54) IN-VEHICLE ANTENNA SYSTEM AND METHOD

(75) Inventors: David R. Petrucci, Sterling Heights, MI (US); Charles A. Massoll, Milford, MI (US); Donald B. Hibbard, Jr., Howell, MI (US); Nathan C. Callaghan, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 327 days.

(21) Appl. No.: 12/794,296

(22) Filed: Jun. 4, 2010

(65) Prior Publication Data

US 2011/0298677 A1 Dec. 8, 2011

(51) Int. Cl.
*H01Q 1/32* (2006.01)

(52) U.S. Cl. ..... 343/713; 343/711; 343/725

(58) Field of Classification Search ..... 343/711, 343/713, 725

See application file for complete search history.

(56) References Cited

U.S. PATENT DOCUMENTS 5,059,971 A * 10/1991 Blaese ..... 343/713
7,064,721 B2 * 6/2006 Zafar et al. ..... 343/725
7,850,078 B2 * 12/2010 Christenson et al. ..... 235/382

FOREIGN PATENT DOCUMENTS

DE 10 2007 029 952 * 1/2009

* cited by examiner

*Primary Examiner* — Hoang V Nguyen

(57) ABSTRACT

An antenna system connectable to a vehicle includes an exterior antenna and an interior antenna. The vehicle has a wall including an outer surface and an inner surface generally opposing the outer surface. The inner surface and the outer surface cooperate together to create an aperture. The wall defines an exterior environment and an interior cabin of the vehicle. The exterior antenna is disposed on the outer surface of the wall, where the exterior antenna transmits and receives RF signals to and from an external RF device that is located in the exterior environment. The interior antenna is located within the interior cabin defined by the inner surface of the wall. The interior antenna receives and transmits RF signals to and from an interior RF device located within the interior cabin.

20 Claims, 1 Drawing Sheet

IN-VEHICLE ANTENNA SYSTEM AND METHOD

FIELD

Figure 1:
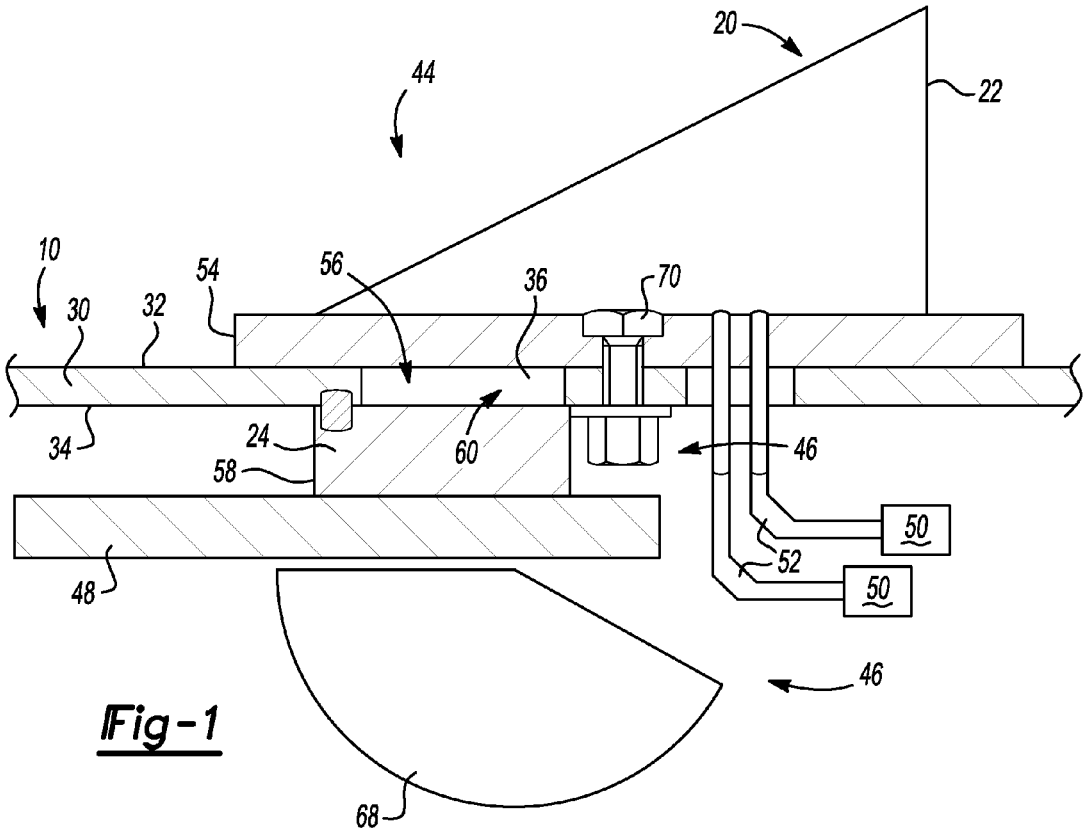

The present disclosure relates to a system and method of communicating radio frequency (RF) signals between antennas, and more particularly to a system and method of communicating RF signals between an exterior environment and an interior cabin.

BACKGROUND

The statements in this section merely provide background information related to the present disclosure and may or may not constitute prior art.

Certain vehicle regulations recently enacted require passenger vehicles to use solar management glass coatings. This type of glass coating causes less infrared energy to be transmitted into the interior cabin of the vehicle, which in turn reduces the heat load in the interior cabin of the vehicle. However, this coating does not generally allow for radio frequency (RF) signals to pass through the glass. As a result, if a portable electronic device is being used within the interior cabin of the vehicle, RF signals such as cellular telephone signals or global positioning system (GPS) signals will generally be unavailable. The portable electronic device is unable to receive the RF signals needed to perform some types of functions. For example, if a personal navigation device (PND) is placed within the interior cabin of the vehicle, a weak or non-existent GPS signal is available. As a result, the PND may not be able to provide positioning data. Moreover, if there is a weak or non-existent signal within the interior cabin, portable electronic devices will constantly search for an RF signal. Searching for RF signals will reduce the battery life of a portable electronic device, which can lead to customer dissatisfaction and complaints. Accordingly, there is a need in the art for a system that will allow RF signals to enter the interior cabin of a vehicle that utilizes solar management glass coatings.

SUMMARY

The present invention provides a method and system for communicating radio frequency (RF) signals between antennas. An antenna system connectable to a vehicle includes an exterior antenna and an interior antenna. The vehicle has a wall including an outer surface and an inner surface that generally opposes the outer surface. The inner surface and the outer surface cooperate together to create an aperture, and the wall defines an exterior environment and an interior cabin. The exterior antenna is disposed on the outer surface of the wall, where the exterior antenna transmits and receives RF signals to and from an external RF device that is located in the exterior environment. The interior antenna is located within the interior cabin defined by the inner surface of the wall, where the interior antenna receives and transmits RF signals to and from an interior RF device located within the interior cabin. The aperture is located within the wall, and is positioned such that the interior antenna communicates RF signals obtained from the interior RF device located within the interior cabin through the aperture and to the exterior antenna. The exterior antenna communicates RF signals obtained from the external RF device through the aperture to the interior antenna.

In an embodiment of the present invention, an outer surface of the exterior antenna is located at one end of the aperture, and an outer surface of the interior antenna is located at the other end of the aperture. The interior and exterior antennas generally oppose one another.

In another embodiment of the present invention, the wall is constructed from either a substantially metal material or a glass panel with a solar management glass coating.

In yet another embodiment of the present invention, the exterior antenna is a fin antenna.

In an embodiment of the present invention, the interior antenna is a patch antenna.

In another embodiment of the present invention, the interior antenna is an omni-directional antenna providing a generally hemispherical RF pattern within the interior cabin.

In yet another embodiment of the present invention, the interior antenna is sized to receive and transmit either global positioning signals (GPS), satellite digital audio radio service (SDARS), or cellular signals.

In an embodiment of the present invention, a fastener is used to attach the exterior antenna to the outer surface of the wall and the interior antenna to the inner surface of the wall.

In another embodiment of the present invention, at least one of the exterior antenna and the interior antenna are passive antennas.

In an embodiment of the present invention, the interior antenna and the exterior antenna are integrated into a single antenna component.

A method of sending and receiving radio frequency (RF) signals from a vehicle is also disclosed. The vehicle has a wall including an outer surface and an inner surface that generally opposes the outer surface. The inner surface and the outer surface cooperate together to create an aperture. The method comprises the step of transmitting a first RF signal from an external RF device to an exterior antenna. The exterior antenna is disposed on the outer surface of the wall. The method further comprises the step of communicating the first RF signal from the exterior antenna to an interior antenna that is located within an interior cabin, where the wall defines an exterior environment and the interior cabin. The aperture is located within the wall such that the exterior antenna communicates the first RF signal through the aperture to the interior antenna. The method further comprises the step of radiating the first RF signal from the interior antenna to the interior cabin such that an interior RF device receives the first RF signal. The method further comprises the step of transmitting a second RF signal from the interior RF device to the interior antenna. Finally, the method comprises the step of communicating the second RF signal from the interior antenna to the exterior antenna, where the aperture is located within the wall such that the interior antenna communicates the second RF signal through the aperture to the exterior antenna.

In an embodiment of the present invention, the method further comprises the step of transmitting the second RF signal from the exterior antenna to the external RF device.

In another embodiment of the present invention, the method further comprises the step of establishing an outer surface of the exterior antenna that is located at one end of the aperture, and an outer surface of the interior antenna that is located at the other end of the aperture. The interior and exterior antennas generally oppose one another.

In yet another embodiment of the present invention, the wall is constructed from either a substantially metal material or a glass panel with a solar management glass coating.

In an embodiment of the present invention, the method further comprises the step of establishing the exterior antenna as a fin antenna.

In another embodiment of the present invention, the method further comprises the step of establishing the interior antenna as a patch antenna.

In yet another embodiment of the present invention, the method further comprises the step of providing a generally hemispherical RF pattern within the interior cabin, where the interior antenna is an omni-directional antenna.

In an embodiment of the present invention, the method further comprises the step of sizing the interior antenna to receive and transmit either global positioning signals (GPS), satellite digital audio radio service (SDARS), or cellular signals.

In another embodiment of the present invention, the method further comprises the step of attaching the exterior antenna to the outer surface of the wall and the interior antenna to the inner surface of the wall by a fastener.

In yet another embodiment of the present invention, the method further comprises the step of establishing at least one of the exterior antenna and the interior antenna as passive antennas.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
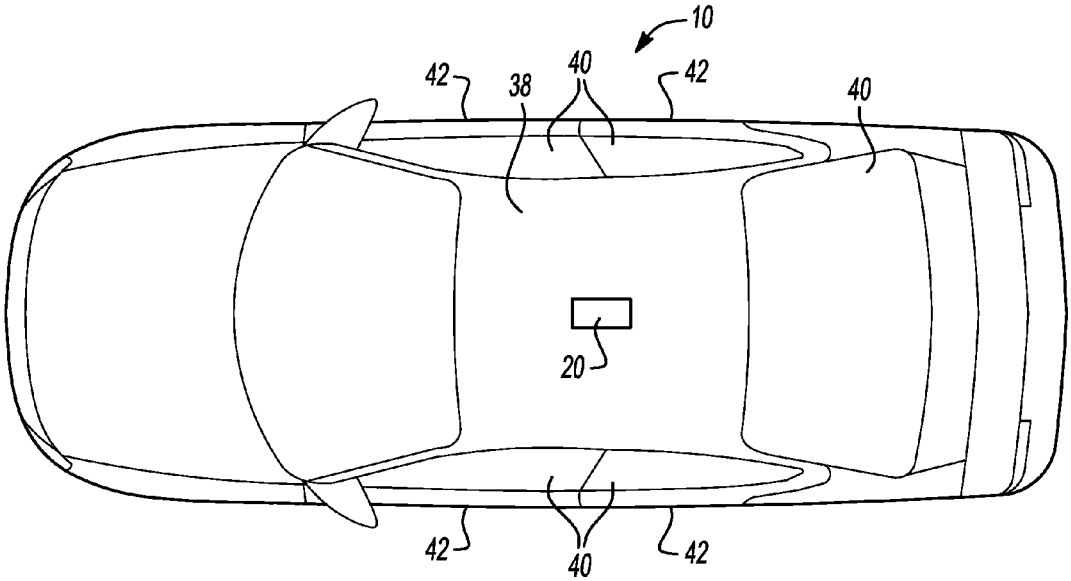

FIG. 1 is a schematic illustration of an exemplary antenna assembly including two antennas on a vehicle; and FIG. 2 is illustrates the vehicle shown in FIG. 1.

DETAILED DESCRIPTION

The following description is merely exemplary in nature and is not intended to limit the present disclosure, application, or uses.

With reference to FIG. 1, a schematic view of a vehicle is generally indicated by reference number 10, where an antenna system 20 for receiving radio frequency (RF) signals is connected to the vehicle 10. The antenna system 20 includes an exterior antenna 22 and an interior antenna 24 that each transmit and receive RF signals. The vehicle 10 includes a wall 30 having an outer surface 32 and an inner surface 34 generally opposing the outer surface 32. The outer surface 32 and the inner surface 34 cooperate together to create an aperture 36 located within the wall 30. The wall 30 is constructed from a material that does not generally allow for RF signals to pass through. In one embodiment, the wall 30 is the roof of the vehicle 10 and is constructed from a metallic material such as, for example, a steel alloy. Alternatively, the wall 30 can be a glass pane, such as the rear glass of the vehicle 10. The glass pane is coated with a solar management glass coating that does not generally allow for RF signals to pass through.

Turning to FIG. 2, the antenna system 20 is illustrated positioned on the roof 38 of the vehicle 10. It should be noted that the antenna system 20 can also be positioned on other parts of the vehicle 10 as well, such as, for example, the side or rear glass 40, or one of the doors 42. Although FIGS. 1-2 illustrate the antenna system 20 employed in a vehicle, those skilled in the art will appreciate that the antenna system 20 can be used in any application where RF signals are transmitted or received.

Turning back to FIG. 1, the wall 30 defines an exterior environment 44 and an interior cabin 46 of the vehicle 10. The exterior environment 44 includes the environment that is located outside of the vehicle 10, while the interior cabin 46 includes the environment within the vehicle 10. The exterior environment 44 is typically any type of outdoor environment. The interior cabin 46 includes an area between a headliner 48 and the wall 30 as well as the interior of the vehicle 10. The exterior antenna 22 is disposed on the outer surface 32 of the wall 30, and the interior antenna element 24 is located within the interior cabin 42. In the embodiment as shown, the interior cabin 46 of the vehicle 10 typically has poor or non-existent RF signal reception. Turning to FIG. 2, the roof 38 is constructed of a metallic material such as a steel alloy, while the vehicle glass 40 is coated with a solar management glass coating that does not generally allow for RF signals to pass through to the interior cabin 46 (FIG. 1). As a result, the antenna system 20 is employed to communicate RF signals between the interior cabin 46 and the exterior environment 44.

In the embodiment as shown in FIG. 1, the exterior antenna 22 is a fin type antenna, however those skilled in the art will appreciate that other types of antennas may be used as well. For example, in another embodiment the exterior antenna 22 could be a mirror type antenna. The exterior antenna 22 can be connected to a vehicle transceiver 50 through a data line 52, if desired. The data line 52 is any type of transmission line for carrying radio frequency signals such as, for example, a coaxial cable. FIG. 1 illustrates two separate transceivers 50, namely a cellular transceiver as well as a satellite digital audio radio service (SDARS) transceiver.

FIG. 1 illustrates the interior antenna 24 as a patch type antenna. The patch type antenna can be sized for a particular frequency. For example, if it is desired to pass SDARS signals, the patch type antenna can be sized to transmit and receive SDARS signals. Alternatively, in another example the patch type antenna could also be sized to transmit and receive cellular telephone signals. In one example, the interior antenna 24 can be several different patch antennas that are integrated to receive several different types of signals, such as, for example, a patch antenna that receives both SDARS as well as GPS signals. In the embodiment as shown, the antenna system 20 has a passive design. This means that the exterior and interior antennas 22 and 24 each do not include an amplifier. However, those skilled in the art will appreciate that the antenna system 20 can also include an active design as well, which means the exterior and interior antennas 22 and 24 are amplified. Specifically, the antennas 22, 24 could have an active design using a two-way amplifier. However, it may be more cost effective to employ a passive design instead in some embodiments, as a passive design does not need an amplifier, therefore reducing cost as well as complexity of the antenna system 20. Moreover, a passive design does not require vehicle electrical load and would not typically impact electric consumption or power requirements of the vehicle 10.

The aperture 36 is positioned within the wall 30 such that RF signals can be communicated between both the exterior and interior antennas 22 and 24. For example, in the embodiment as shown the exterior antenna 22 generally opposes the interior antenna 24 at the aperture 36 such that an outer surface 54 of the exterior antenna 22 is located at one end 56 of the aperture 36, and an outer surface 58 of the interior antenna 24 is located at the other end 60 of the aperture 36. With the interior and exterior antennas 22 and 24 positioned in this configuration, RF signals can be communicated between the antennas 22, 24 through the aperture 36. Specifically, the interior antenna 24 communicates RF signals obtained from the interior cabin 46 through the aperture 36 and to the exterior antenna 22. The exterior antenna 22 communicates RF signals obtained from the external environment 44 through the aperture 36 to the interior antenna 24.

If a portable electronic RF device (not shown) is located within the interior cabin 46 of the vehicle 10, the electronic RF device is generally unable to send or receive RF signals from an external RF device that is located in the exterior environment 44. This is because RF signal reception is typically poor or non-existent within the interior cabin 46 of the vehicle, as the roof 38 and the vehicle glass 40 (FIG. 2) are constructed from materials that do not generally allow for RF signals to pass through. The portable electronic RF device can be any type of portable electronic device that is capable of transmitting RF signals, receiving RF signals, or both. For example, the electronic RF device could be a cellular telephone, a laptop computer with a wireless Internet connection, an AM/FM radio, or a personal navigation device (PND). The external RF device is any type of structure located in the environment outside of the interior cabin 46 of the vehicle 10 that is capable transmitting RF signals, receiving RF signals or both. For example, the external RF device could be a GPS satellite, a cellular telephone tower, an AM radio tower, or an FM radio tower.

In one example, if a portable electronic RF device such as a PND is located within the interior cabin 46 of the vehicle, the RF signals can not generally travel through the wall 30 and communicate with an external RF device such as a GPS satellite. Instead, the antenna system 20 transmits the RF signals from the interior cabin 46 to the satellite located outside of the vehicle 10. First, the portable electronic RF device communicates an RF signal to the interior antenna 24. The RF signal is communicated from the interior antenna 24, through the aperture 36, and to the exterior antenna 22. The exterior antenna 22 communicates the RF signal to a satellite, where the RF signal contains information such as, for example, the position of the vehicle 10 in relation to Earth. The satellite then communicates an RF signal to the exterior antenna 22 containing information such as, for example, directions from the vehicle's present position to another predetermined destination. The RF signal is communicated from the exterior antenna 22, through the aperture 36, and to the interior antenna 24. The interior antenna 24 then radiates the RF signal into the interior cabin 46, and provides an RF signal to the portable electronic RF device. In the embodiment as illustrated, the interior antenna 24 is an omni-directional antenna that provides a generally hemispherical pattern 68 within the interior cabin 46, however it is understood that the interior antenna 24 can radiate different types of antenna patterns as well.

FIG. 1 illustrates a fastening device 70 that is used to position the exterior antenna 22 on the outer surface 32 of the wall 30 and the interior antenna 24 within the interior cabin 46. The fastening device 70 can be any type of fastener that is used to secure the exterior and interior antennas 22 and 24 to the wall 30 such as, for example, a bolt. In the embodiment as illustrated, the exterior antenna 22 is a separate component from the interior antenna 24, however in an alternative embodiment the exterior and interior antennas 22 and 24 could be integrated into a single antenna component. For example, the exterior antenna 22 could extend through the aperture 36 and into the interior cabin 46, thereby acting as an antenna for both the exterior and interior cabins 44 and 46. The antenna assembly 20 can be installed on the vehicle 10 during production. Alternatively, the antenna assembly 20 is a retrofit, where the aperture 36 could be added to the vehicle 10 and the exterior and interior antennas 22 and 24 could be installed after production.

With continued reference to FIGS. 1-2, a method for communicating an RF signal with the antenna system 20 is generally described. The method begins at a first step, where the antenna system 20 including the exterior antenna 22 and the interior antenna 24 is established. The outer surface 32 and the inner surface 34 of the wall 30 cooperate together to create the aperture 36. The aperture 36 is positioned such that the exterior and interior antennas 22 and 24 can communicate RF signals between one another through the aperture 36. In one embodiment, the antenna system 20 is connected to a vehicle 10, however it is understood that the antenna system 20 may be employed in other applications as well. The method then proceeds to a second step.

In the second step, a first RF signal is transmitted from an external RF device to the exterior antenna 22. The first RF signal can be any type of radio frequency signal such as, for example, a cellular telephone signal. The external RF structure is any type of structure that is capable of transmitting RF signals, receiving RF signals, or both. For example, the external RF structure could be a GPS satellite, a cellular telephone tower, and an FM or AM radio tower. The method may then proceed to a third step.

In the third step, the first RF signal is communicated from the exterior antenna 22 to the interior antenna 24 through the aperture 36 located in the wall 30. The aperture 36 is positioned such that RF signals can be communicated between both the exterior and interior antennas 22 and 24. Specifically, FIG. 1 illustrates the exterior antenna 22 generally opposing the interior antenna 24 at the aperture 36 such that an outer surface 54 of the exterior antenna 22 is located at one end 56 of the aperture 36, and an outer surface 58 of the interior antenna 24 is located at the other end 60 of the aperture 36. The method may then proceed to a fourth step.

In the fourth step, the first RF signal is radiated from the interior antenna 24 and into the interior cabin 46 such that the electronic RF device receives the first RF signal. For example, FIG. 1 illustrates the interior antenna 24 as an omni-directional antenna that provides a generally hemispherical pattern 68 within the interior cabin 46. However, it is understood that the interior antenna 24 can radiate different types of antenna patterns as well. The method may then proceed to a fifth step.

In the fifth step, a second RF signal from the electronic RF device is transmitted to the interior antenna 24. The electronic RF device any type of portable electronic device that is capable of transmitting RF signals, receiving RF signals, or both. In the fifth step, the electronic RF device transmits the second RF signal into the interior cabin 46 of the vehicle 10, and the interior antenna 24 receives the second RF signal. The method may then proceed to a sixth step.

In the sixth step, the second RF signal is communicated from the interior antenna 24 to the exterior antenna 22 through the aperture 36 located in the wall 30. Similar to the third step, the aperture 36 is positioned within the wall 30 such that RF signals can be communicated between both the exterior and interior antennas 22 and 24. The method may then proceed to the seventh step.

In the seventh step, the second RF signal is transmitted from the exterior antenna 22 to the external RF device. For example, if the RF signal is a GPS signal, then the second RF signal is communicated to a GPS satellite. The second RF signal can include information, such as for example, the position of the vehicle 10 in relation to the Earth. In one embodiment, the method may then proceed back to the second step. For example, the GPS satellite could then communicate a RF signal to the exterior antenna 22 containing information such as, for example, directions from the vehicle's present position to another predetermined destination. Alternatively, the method may then terminate.

The description of the invention is merely exemplary in nature and variations that do not depart from the gist of the invention are intended to be within the scope of the invention. Such variations are not to be regarded as a departure from the spirit and scope of the invention.

What is claimed is:

1. An antenna system connectable to a vehicle having an interior cabin, the antenna system comprising:

a wall including an outer surface and an inner surface that generally opposes the outer surface, wherein the inner surface and the outer surface cooperate together to create an aperture, and wherein the wall defines an exterior environment and the interior cabin;

an exterior antenna disposed on the outer surface of the wall, wherein the exterior antenna transmits and receives RF signals to and from an external RF device that is located in the exterior environment; and an interior antenna located within the interior cabin defined by the inner surface of the wall, wherein the interior antenna receives and transmits RF signals to and from an interior RF device located within the interior cabin, and wherein the aperture located within the wall is positioned such that the interior antenna communicates RF signals obtained from the interior RF device located within the interior cabin through the aperture and to the exterior antenna, and the exterior antenna communicates RF signals obtained from the external RF device through the aperture to the interior antenna.

2. The antenna system of claim 1 wherein an outer surface of the exterior antenna is located at one end of the aperture, and an outer surface of the interior antenna is located at the other end of the aperture, and wherein the interior and exterior antennas generally oppose one another.

3. The antenna system of claim 1 wherein the wall is constructed from one of a substantially metal material and a glass panel with a solar management glass coating.

4. The antenna system of claim 1 wherein the exterior antenna is a fin antenna.

5. The antenna system of claim 1 wherein the interior antenna is a patch antenna.

6. The antenna system of claim 1 wherein the interior antenna is an omni-directional antenna providing a generally hemispherical RF pattern within the interior cabin.

7. The antenna system of claim 1 wherein the interior antenna is sized to receive and transmit one of global positioning signals (GPS), satellite digital audio radio service (SDARS), and cellular signals.

8. The antenna system of claim 1 wherein a fastener is used to attach the exterior antenna to the outer surface of the wall and the interior antenna to the inner surface of the wall.

9. The antenna system of claim 1 wherein at least one of the exterior antenna and the interior antenna are passive antennas.

10. The antenna system of claim 1 wherein the interior antenna and the exterior antenna are integrated into a single antenna component.

11. A method of sending and receiving radio frequency (RF) signals from a vehicle, wherein the vehicle has a wall including an outer surface and an inner surface that generally opposes the outer surface, wherein the inner surface and the outer surface cooperate together to create an aperture, the method comprising:

transmitting a first RF signal from an external RF device to an exterior antenna, wherein the exterior antenna is disposed on the outer surface of the wall;

communicating the first RF signal from the exterior antenna to an interior antenna that is located within an interior cabin, where the wall defines an exterior environment and the interior cabin, and wherein the aperture is located within the wall such that the exterior antenna communicates the first RF signal through the aperture to the interior antenna;

radiating the first RF signal from the interior antenna to the interior cabin such that an interior RF device receives the first RF signal;

transmitting a second RF signal from the interior RF device to the interior antenna; and communicating the second RF signal from the interior antenna to the exterior antenna, wherein the aperture is located within the wall such that the interior antenna communicates the second RF signal through the aperture to the exterior antenna.

12. The method of claim 11 wherein the method further comprises transmitting the second RF signal from the exterior antenna to the external RF device.

13. The method of claim 11 wherein the method further comprises establishing an outer surface of the exterior antenna that is located at one end of the aperture, and an outer surface of the interior antenna that is located at the other end of the aperture, wherein the interior and exterior antennas generally oppose one another.

14. The method of claim 11 wherein the wall is constructed from one of a substantially metal material and a glass panel with a solar management glass coating.

15. The method of claim 11 wherein the method further comprises establishing the exterior antenna as a fin antenna.

16. The method of claim 11 wherein the method further comprises establishing the interior antenna as a patch antenna.

17. The method of claim 11 wherein the method further comprises providing a generally hemispherical RF pattern within the interior cabin, and wherein the interior antenna is an omni-directional antenna.

18. The method of claim 11 wherein the method further comprises sizing the interior antenna to receive and transmit one of global positioning signals (GPS), satellite digital audio radio service (SDARS), and cellular signals.

19. The method of claim 11 wherein the method further comprises attaching the exterior antenna to the outer surface of the wall and the interior antenna to the inner surface of the wall by a fastener.

20. The method of claim 11 wherein the method further comprises establishing at least one of the exterior antenna and the interior antenna as passive antennas.

* * * * *